US007114444B2

(12) United States Patent
Hutchinson et al.

(10) Patent No.: US 7,114,444 B2
(45) Date of Patent: Oct. 3, 2006

(54) APPARATUS AND METHOD FOR PROVIDING REGISTERED PRINTING ON SEPARATE CONTINUOUS WEBS OF PAPERBOARD MATERIAL FOR FORMING INTO MULTIPLE BOX BLANKS

(75) Inventors: Arthur C. Hutchinson, Durand, MI (US); Mark A. Blackburn, Durand, MI (US)

(73) Assignee: Compak, Inc., Flint, MI (US)

( * ) Notice: Subject to any disclaimer, the term of this patent is extended or adjusted under 35 U.S.C. 154(b) by 0 days.

(21) Appl. No.: 10/837,532

(22) Filed: Apr. 30, 2004

(65) Prior Publication Data

US 2005/0085362 A1 Apr. 21, 2005

Related U.S. Application Data

(60) Provisional application No. 60/483,856, filed on Jun. 30, 2003.

(51) Int. Cl.
*B41F 33/00* (2006.01)

(52) U.S. Cl. ..... 101/483; 101/219; 101/228; 493/3

(58) Field of Classification Search ..... 101/228; 493/8–11
See application file for complete search history.

(56) References Cited

U.S. PATENT DOCUMENTS 4,545,780 A * 10/1985 Martin ..... 493/11
5,818,719 A * 10/1998 Brandon et al. ..... 700/125
6,059,705 A * 5/2000 Ruthenberg et al. ..... 493/11
6,454,689 B1 * 9/2002 Voss ..... 493/11

* cited by examiner

*Primary Examiner*—Andrew H. Hirshfeld
*Assistant Examiner*—Marissa L. Ferguson
(74) *Attorney, Agent, or Firm*—Young & Basile, P.C.

(57) ABSTRACT

An apparatus and method for forming continuous webs of paperboard material into multiple box blanks having dual-faced printing. The apparatus comprises a printer for repetitively applying indicia to a first continuous web of paperboard material at predetermined intervals along the longitudinal axis thereof as the first continuous web moves through the printer, the printer including a motor-driven printing cylinder having a circumferential printing surface, and an impression cylinder; at least a first sensor operative to detect reference marks pre-printed on a second continuous web of paperboard material at predetermined intervals along the longitudinal axis thereof; at least one encoder operative to generate signals corresponding to the rotational speed of the impression cylinder; and a computer controller: (1) connected to the at least first sensor to receive information corresponding to the position of the reference marks pre-printed on the second web; (2) connected to the at least one encoder to receive signals corresponding to the rotational speed of the impression cylinder; and (3) connected to the printing cylinder motor and operative to match the rotational speed of the printing cylinder to the rotational speed of the impression cylinder as established by the at least one encoder, and further operative to selectively adjust the rotational speed of the printing cylinder in order to bring the printing applied by each revolution of the printing cylinder into the area defined between adjacent reference marks on the second continuous web as detected by the at least first sensor.

17 Claims, 5 Drawing Sheets

APPARATUS AND METHOD FOR PROVIDING REGISTERED PRINTING ON SEPARATE CONTINUOUS WEBS OF PAPERBOARD MATERIAL FOR FORMING INTO MULTIPLE BOX BLANKS

PRIORITY CLAIM

This invention claims priority under Provisional Patent Application Ser. No. 60/483,856, filed Jun. 30, 2003.

FIELD OF THE INVENTION

This invention pertains generally to apparatus and methods for the in-line manufacture of box blanks from separate webs of paperboard material, and more particularly to an apparatus and method for forming such separate webs of paperboard material into multiple box blanks having controllably registered printing provided on both of the opposite faces thereof.

BACKGROUND

Previously, boxes formed of paperboard material were made by severing the multi-layered material into individual boards and subsequently printing, cutting, and scoring in multiple stages of operations to form individual, two-dimensional box blanks. These limitations were addressed in U.S. Pat. No. 4,545,780, assigned to the assignee of the instant application, which patent discloses an apparatus and method of making cartons wherein the separate printing, cutting, and scoring stages are combined into a single, continuous operation. Despite this advancement in the art, however, it remains the case that printing both sides of box blanks in non-random fashion in the continuous operation of U.S. Pat. No. 4,545,780 is problematical.

Presently, the printing step is addressed to a single face of the box blanks only; customarily, the surface of the web of material constituting the outside of the finished box blank. This conventional printing operation comprises threading a first web of paperboard material through one or more printing decks for the application of desired indicia thereon in one or more colors, all as explained more fully in U.S. Pat. No. 4,545,780, the disclosure of which is incorporated by reference herein in its entirety.

While the inventors hereof have previously developed means for printing indicia on both faces of the box blank, these means have been of limited utility because it has heretofore not been possible, to their knowledge, to align the separate box blanks defined on each of the separate webs of paperboard material before they are joined together to define the unitary web from which the individual box blanks are cut, in consequence of which fact the resulting box blanks are characterized by properly aligned indicia on one surface thereof, and randomly oriented indicia on the opposite surface thereof.

It would therefore be desirable to have an apparatus and method for the continuous formation of paperboard box blanks wherein the printed indicia provided on the separate webs of paperboard material are aligned, or registered, before these separate webs are joined together to form the unitary web from which the box blanks are cut.

SUMMARY OF THE INVENTION

The limitations of the prior art are addressed by an improved method and apparatus for creating paperboard box blanks from a unitary paperboard web formed from at least first and second continuous webs of paperboard material generally moving at the same rate of travel through the apparatus, the improvement comprising an apparatus for applying printing to the first continuous web of paperboard material, before the first and second webs are joined to define the unitary paperboard web, such that the printing on the first web is registered to printing provided on the second continuous web. The apparatus of the invention more particularly comprises: A printer for repetitively applying indicia to the first continuous web of paperboard material at predetermined intervals along the longitudinal axis thereof as the first continuous web moves through the printer, the printer including a motor-driven printing cylinder having a circumferential printing surface, and an impression cylinder having a rotational speed determined by the rate of travel of the first continuous web through the printer; at least one sensor operative to detect reference marks printed on the second web at predetermined intervals along the longitudinal axis thereof; at least one encoder operative to generate signals corresponding to the rotational speed of the impression cylinder; and a computer controller: (a) connected to the at least one sensor to receive information corresponding to the position of the reference marks printed on the second web; (b) connected to the at least one encoder to receive signals corresponding to the rotational speed of the impression cylinder; and (c) connected to the printing cylinder motor and operative to selectively control the rotational speed of the printing cylinder to match the rotational speed of the impression cylinder as established by the at least one encoder, and further operative to selectively accelerate or retard the rotational speed of the printing cylinder in order to bring the printing applied by each revolution of the printing cylinder into the area defined between adjacent reference marks on the second continuous web as detected by the at least one sensor.

BRIEF DESCRIPTION OF THE DRAWINGS

These and other objects, features, and advantages of the present invention will become apparent upon reference to the following description and drawings, in which.

DESCRIPTION OF THE ILLUSTRATED EMBODIMENT

Figure 1:
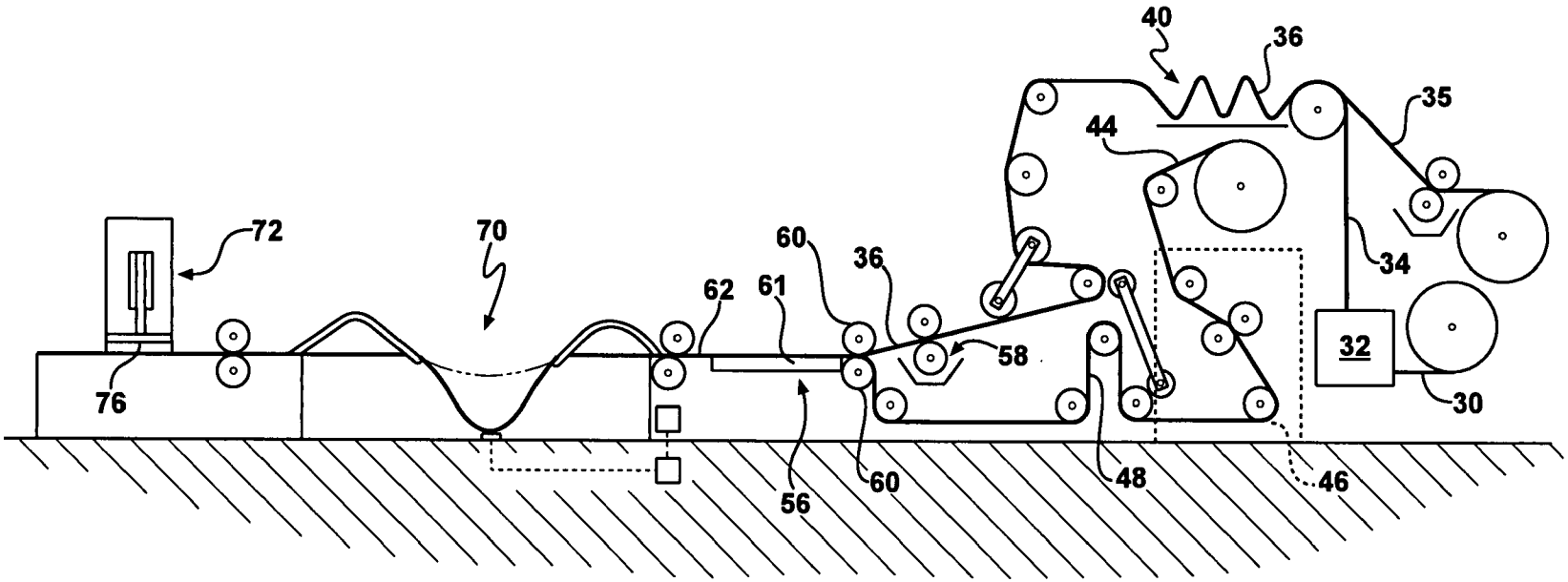
FIG. 1 is a diagrammatic illustration of an exemplary in-line paperboard box-manufacturing process.

Referring now to the drawings, wherein like numerals refer to like or corresponding parts throughout the several views, the present invention will be seen to generally comprise an apparatus and corresponding method for controllably registering the printing on a first web of paperboard material to the printing provided on a second web of paperboard material in a continuous process for manufacturing blanks for forming paperboard boxes.

As used herein, the term "registration" means the alignment between locations on each of two separate, continuous webs of paperboard material, such as the first and second webs described herein, and includes the alignment between registration marks, as well as the alignment between indicia printed on each of the separate webs of paperboard material.

Figure 2:
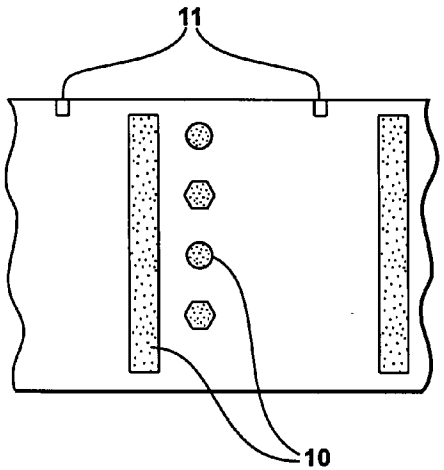
FIG. 2 depicts the surface of a web of paper board material having indicia printed thereon.

Turning first to FIG. 1, shown is an exemplary box-manufacturing apparatus; that is, an apparatus for the manufacture of two-dimensional blanks of pre-printed paperboard material such as exemplified in FIG. 2, into which exemplary apparatus the present invention is ideally incorporated. While the apparatus of FIG. 1 is specifically adapted to the formation of corrugated-cardboard box blanks, it will be understood that this apparatus is exemplary only, and that the improvement of this invention may be incorporated into other such apparatus for forming paperboard box blanks, whether comprised of two, three, or even more layers of paperboard material.

Figure 3:
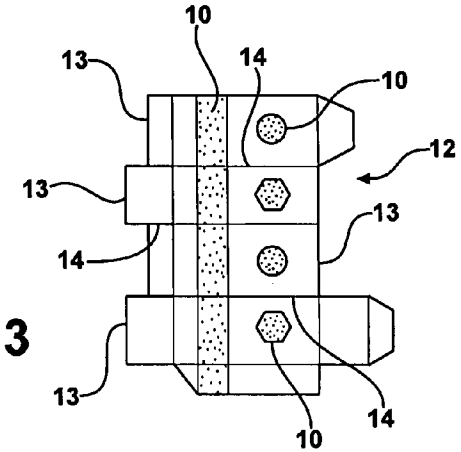
FIG. 3 depicts an exemplary paperboard box blank formed by the manufacturing process illustrated in FIG. 1.

As shown best in FIGS. 2 and 3, each box blank 12 is formed of a double-faced corrugated paper, and typically includes a plurality of sides 13 foldable along scores or creases 14. Each face (only one face is shown) includes indicia 10 in one or more colors, in addition to registration marks 11.

With continuing reference to FIG. 1, the exemplary box-manufacturing apparatus broadly comprises stations for forming, printing, scoring and cutting each box blank. More particularly, the exemplary apparatus includes a paper web 30 which is delivered to a corrugating machine 32 to produce a corrugated web 34 characterized by transversely extending corrugations. The corrugated web 34 is, in turn, bonded to a web 35 to form a so-called single-faced web 36. By reason of the corrugations of the corrugated web 34, the single-faced web 36 is relatively stiff in the transverse direction, while being relatively flexible in the longitudinal direction. The web 36 is temporarily accumulated at an accumulator station 40.

A further web 44 of paper stock is delivered to a printing machine 46, at which the web 44 is printed in one or more colors with such indicia 10 as may be desired, along with longitudinally spaced-apart reference, or registration, marks 11 demarking the separation between adjacent printed areas of the web, all as shown in FIG. 3. The thus printed web 48 is delivered from the printing machine 46 to a bonding machine 56, commonly referred to as a double-backer. Also delivered to the bonding machine 56 is the single-faced web 36, which web passes through a gluing station 58 at which adhesive is applied to the corrugated face of the single-faced web 36. Subsequently, the printed web 48 and the single-faced web 36 pass through rollers 60 and are discharged to heaters 61 which cure the adhesive applied to the corrugated web portion, thereby forming a unitary, double-backed web 62.

The unitary web 62 moves along a conveyor to an accumulating station 70 which receives the web 62 continuously from the bonding machine 56 and supplies the web 62 intermittently to a cutting and scoring station 72 in a motion synchronized with the motion of a reciprocating die 76 forming part of the cutting and scoring station 72.

Figure 4:
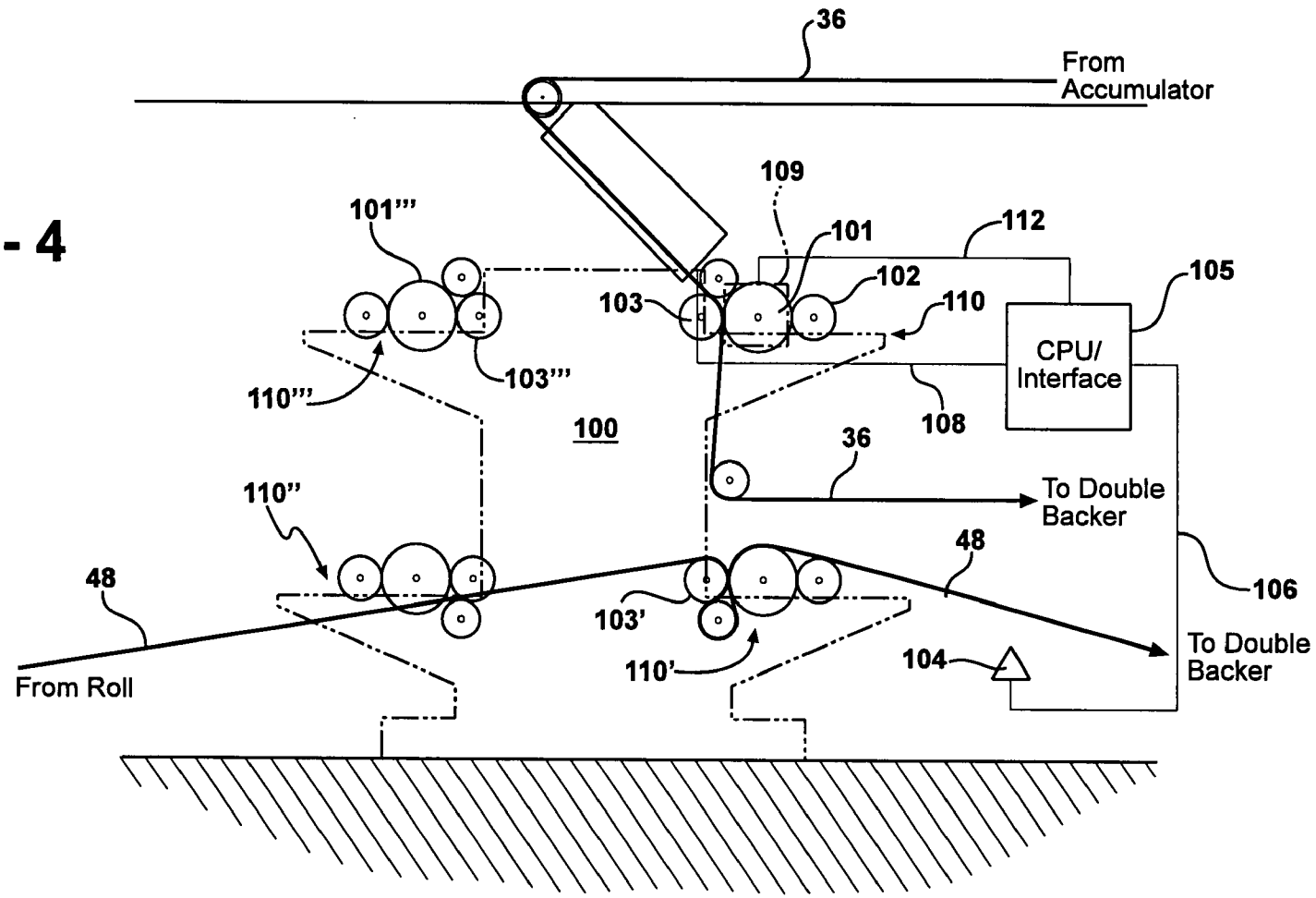
FIG. 4 is a diagrammatic illustration of the apparatus of the present invention for controllably registering the application of printing to a the first web to the printing provided on a second web.

According to the present invention, shown schematically in FIG. 4, the problem of providing printed indicia on the first continuous web 36 in alignment with the printed indicia on the second web 48 is solved by means of an apparatus generally comprising the following: A printer 100 for repetitively applying indicia to the first continuous web 36 of paperboard material at predetermined intervals along the longitudinal axis thereof as the first continuous web 36 moves through the printer 100, the printer including a motor-driven printing cylinder 101 having a circumferential printing surface, an ink roller 102 providing printing ink to the printing cylinder 101, and an impression cylinder 103 having a rotational speed determined by the rate of travel of the first continuous web 36 through the printer 100; at least one sensor 104 operative to detect reference marks (see reference numeral 11, FIG. 3) pre-printed on the second web 48 at predetermined intervals along the longitudinal axis thereof; at least one encoder (not visible in FIG. 4) operative to generate signals corresponding to the rotational speed of the impression cylinder; and a computer controller 105 (a) operatively connected 106 to the at least one sensor 104 to receive information corresponding to the position of the reference marks pre-printed on the second web 48, (b) operatively connected 107 to the at least one encoder to receive signals corresponding to the rotational speed of the impression cylinder 103, and (c) operatively connected 108 to the printing cylinder motor 109 and operative to match the rotational speed of the printing cylinder 101 to the rotational speed of the impression cylinder 103 as established by the at least one encoder, and further operative to selectively adjust the rotational speed of the printing cylinder 101 in order to bring the printing applied by each revolution of the printing cylinder 101 into the area defined between adjacent reference marks on the second continuous web 48 as detected by the at least one sensor 104.

Still referring to FIG. 4, according to which an embodiment of the apparatus of the invention is shown in combination with an exemplary box-manufacturing apparatus such as described and shown in FIG. 1, the various elements of the present invention and their interrelation will be better understood. More particularly, the first continuous web 36 is fed from an accumulator station, such as accumulator station 40 of FIG. 1, to the printer 100. The accumulator station in the illustrated embodiment is shown as being positioned above the printer 100, though the web 36 may be presented to the printer 100 otherwise. The printer 100 is of conventional manufacture, except as otherwise indicated, and includes one or more printing decks 110, each such printing deck comprising, according to convention, a printing cylinder 101 including a desired printing die corresponding to the indicia to be printed onto the web 36, and an impression cylinder 103. The printing die is, as affixed to the printing cylinder 101, in the form of a plate having an incomplete cylindrical shape characterized by a longitudinal gap of given dimensions defined between opposing edges of the plate. As is known, an ink roller transfers a printing ink in a desired color from a pan or trough (not shown) to the printing die provided on the printing cylinder 101. From the accumulator, the web 36 passes between the printing cylinder 101 and the impression cylinder 103, the impression cylinder providing a surface against which the printing cylinder 101 acts in printing upon the web 36, as is known. As the first continuous web 36 passes through the at least one deck 110 of the printer 100 as shown, the desired indicia are repeatedly printed upon the upper surface of the web 36 with each revolution of the printing cylinder 101. While the illustrated embodiment shows the application of only a single color of print to the web 36, those of skill in the art, having the benefit of this disclosure, will appreciate that multiple colors of print may be applied by passing the web 36 through more than one print deck, each being constructed as the print deck 110. As will also be understood by those skilled in the art, the distance between adjacent, identical indicia printed upon the web 36 will vary according to the circumference of the printing cylinder 101. Upon exiting the printer 100, the thus printed first web 36 is transferred to the double backer, where the first 36 and second 48 webs are joined in the manner heretofore described.

Still referring to FIG. 4, the second continuous web 48 comprises a pre-printed web of paperboard material provided to the printer 100 from a roll or other source (not shown in FIG. 4). The web 48 may, as shown, be printed, re-wound, and provided to the printer 100, or may be printed in-line in one or more colors, such as in the manner shown in FIG. 1, and thereafter fed directly to the printer 100. The second continuous web 48 is fed through—or nipped—to the impression cylinder 103' of the printing deck 110' in the printer 100 that is positioned below the printing deck 110 through which the first continuous web 36 is fed. By this arrangement, movement of the second web 48 through the printer 100 serves to drive the impression cylinder 103 of the printing deck 110, which printing deck 110 is slaved to the impression cylinder 103' of the printing deck 110', for instance by pulleys, belts, gearing, or other mechanical linking means.

Figure 5:
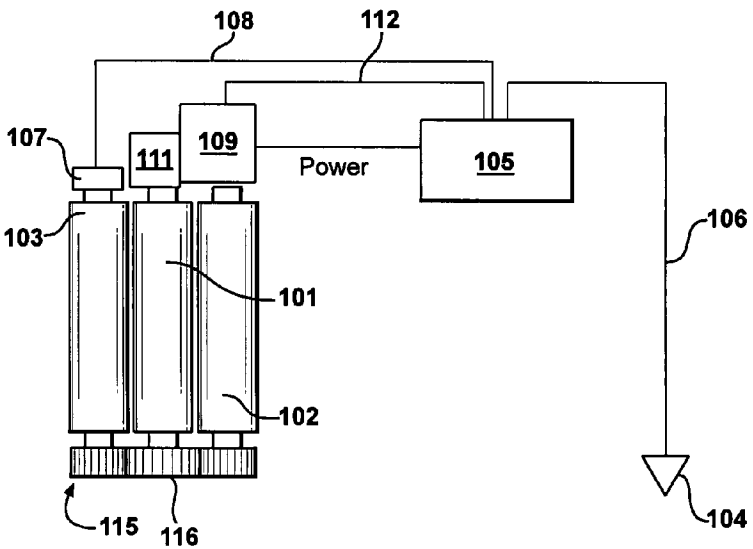
FIG. 5 is a diagrammatic illustration detailing the operational interrelationship between the printer, the sensor, and the computer control in the apparatus of the present invention.

Referring also to FIG. 5, the impression cylinder 103 of the print deck 110 includes an encoder 107 operatively coupled 108 to the computer controller 105. The encoder 107 is operative to provide the computer controller 105 with information representing the rotational speed of the impression cylinder 103 and, by reason of the mechanical interrelationship between the two components, the rotational speed of the impression cylinder 103'.

The print cylinder 101 of the print deck 110 is, in the apparatus of this invention, independently driven by a suitable motor, such as the illustrated servo-motor 109. The servo-motor 109 is further operatively coupled to the printing cylinder 101 via a gear box 111. As illustrated, the servo-motor 109 is operatively coupled 112 to the computer controller 106, which is operative to control the servo-motor 109 to drive the printing cylinder 101 at a rotational speed complementary to the rotational speed of the impression cylinder 103 as established by the encoder 107. As shown, the servo-motor 109 may be powered via the computer controller 105.

Figure 6:
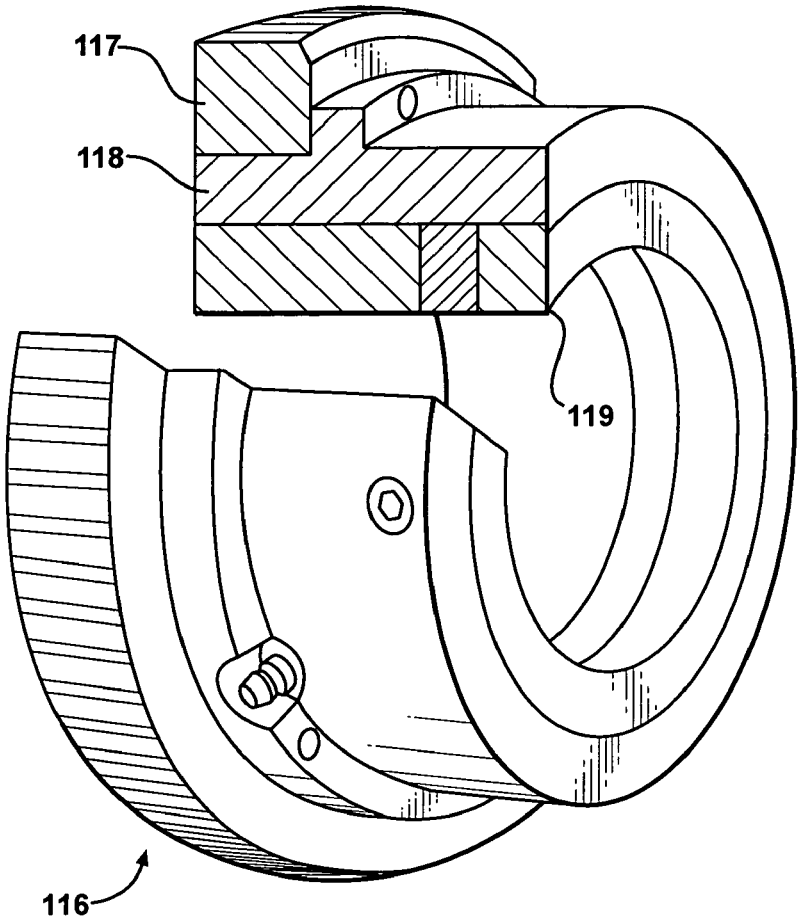
FIG. 6 illustrates a modified slip gear used in the apparatus of the invention.

In conventional printers such as employed in the illustrated embodiment of the present invention, each of the printing cylinder 101, impression cylinder 103, and ink roller 102 of each printing deck 110 are slaved together and driven by a common drive motor (not shown). More particularly, such drive motor drives the impression cylinder 103, which in turn is operatively connected to the printing cylinder 101, which in its turn is operatively coupled to the ink roller 102. The operative connections referenced may take the form of meshed gears 115, such as shown, as well as other conventional means. In order to facilitate independent rotational movement of the printing cylinder 101 in the apparatus and method of the instant invention, a slip gear 116 is provided which permits the translatory motion of the ink roller 102 via rotational movement of the impression cylinder 103. More particularly, the slip gear 116, best shown in partial cut-away in FIG. 6, is affixed by means of a fastener collar 119 to the printing cylinder (not shown). A toothed gear member 117 rotatably disposed on the gear housing 118 is intermeshed with fixed gears (not shown) disposed on each of the impression cylinder (not shown) and the ink roller (not shown), the rotatable gear member 117 moving freely on the gear housing 118 to translate the driving movement of the impression cylinder gear (not shown) to the ink roller gear (not shown). Of course, the foregoing means are not intended to be limiting of the present invention, and other means for translating movement of the impression cylinder gear to the ink roller are certainly contemplated.

A sensor 104, such as for example a photo-eye sensor, is positioned proximate the printed surface of the second web 48 and is operative to detect the registration marks printed thereon, such as the registration marks 11 illustrated in FIG. 2. The computer controller 105 is operatively connected 106 to the sensor 104 to receive a signal when each registration mark is sensed.

A user interface (not shown) is further provided to permit user interaction with the computer controller 105, in the manner and for such purposes as described further herein. The interface may, as in the exemplary embodiment of this invention, be part of the computer controller, comprising for instance a touch-screen display operatively associated with the computer controller 105, although other human-computer interface devices known to those skilled in the art may be equally adopted to the uses herein described.

Referring again to FIG. 4, the manner of controllably registering the provision of printing to the first, or inside, web 36, with the printing provided on the second, or outside, web 48 will be better understood.

The method and apparatus of this invention are essentially characterized by three operational conditions: "Start-up," during which the first 36 and second 48 webs are brought into initial registration; "registration holding," during which the first 36 and second 48 webs are in registration; and "registration adjustment," during which the first 36 and second 48 webs are returned to the condition of registration holding.

In the initial operation of the apparatus of this invention, the first 36 and second 48 webs are positioned as shown in FIG. 4. From this state, the operator manually advances the second web 48 so that a registration mark thereon is positioned in the path of the sensor 104. Thereafter, the first 36 and second 48 webs are brought into initial registration. In the "start-up" condition, the printing applied to the first web 36 is initially manually brought into registration with the printing provided on the second web 48; that is, the printing applied to the first web 36 is aligned between successive registration marks provided on the second web 48. This manual registration is accomplished via the user interface with the computer controller 105, from which the operator can incrementally adjust the rotational speed of the printing cylinder 101 in order to selectively vary, as necessary, the placement along the longitudinal axis of the first web 36 of the printing applied thereto in order to align this printing between successive registration marks printed on the second web 48. More particularly, the computer controller 105 effects, via the servo-motor 109 and, in turn, the gear box 111, an incremental increase or decrease in the rotational speed of the printing cylinder 101 in order to reposition the printing applied by the printing cylinder 101. Because the print die on the printing cylinder 101 covers most, but not all, of the circumference of the printing cylinder 101, it will be appreciated that there is a slight gap in the otherwise continuous contact between the print die and the printed surface of the first web 36. Accordingly, incremental changes in the rotational speed of the printing cylinder 101, and thus the rotational position of the print die, are effected by the computer controller 105 at the point in the printing cylinder's 101 rotation where the gap in the print die is adjacent the surface of the first web 36 where the print is being applied. In this fashion, it is possible to briefly adjust the rotational speed, and thus the rotational position, of the printing cylinder 101 without simultaneously effecting unwanted movement of the first web 36 at a speed other than its normal rate of travel as determined by the movement of the second web 48. From the foregoing, it will be understood that the repositioning of indicia applied to the printed surface of the first web 36 is accomplished in most circumstances not instantaneously, but rather through "walking" the applied printing to its desired position relative to the location of the printing on the second web 48.

In the illustrated embodiment, the computer controller 105 permits at least two different degrees of adjustment in the rotational speed of the printing cylinder 101, measured in terms of the incremental distance displacement, either "forward" or backward, of the printing applied to the first web 36. (Because the continuous first web 36 is constantly moving through the printer 100, the printing applied by the printing cylinder 101 is never actually positioned forward of where it would be applied if a change in the rotational speed of the printing cylinder 101 were not effected. Rather, the term "forward" in this context refers to the fact that the printing is applied to the first web 36 sooner than it otherwise would have been, thus advancing the position of the printing.) These degrees of adjustment are referred to as "coarse" and "fine." For coarse adjustments, this incremental displacement of the printing cylinder 101 in the illustrated embodiment is ¼ inches; for fine adjustments, the incremental displacement in the illustrated embodiment is $1/16^{th}$ inches. Of course, it will be appreciated that the computer controller 105 may be programmed to permit coarse and fine adjustments in increments other than as described in conjunction with the exemplary embodiment of this invention.

In the exemplary embodiment, the coarse and/or fine adjustments are enabled by a touch-screen user interface, each selection effecting a corresponding, displacement by the selected amount. Preferably, the computer controller 105 is operative to process cumulative adjustment instructions, such that the incremental distance displacement, either "forward" or backward, of the printing applied to the first web 36 can be effected to greater degrees. In the exemplary embodiment, the computer controller 105 is therefore operative to process multiple coarse or fine adjustment commands entered via the user interface as a single command for cumulative displacement of the printing applied to the first web 36. Thus, for instance, a user command to displace the printing applied to the first web 36 by 1 inch would be entered by selecting the coarse adjustment control 4 times in a row, though the command would be processed over as many revolutions of the printing cylinder 101 as necessary, subject to the limitation of the dimensions of the gap in the print die. For example, a user command to displace the printing applied to the first web 36 by 1 inch, entered by selecting the coarse adjustment control 4 times, would be effected over four revolutions of a printing cylinder 101 wherein the gap in the print die was about ¼ inch across.

To facilitate the start-up operation, a registration mark (not shown) is preferably applied to the first web 36 with each revolution of the printing cylinder 101. As indicated, the sensor 104 reads successive registration marks on the second web 48, and the computer controller 105 receives this information and provides an indication, for instance via a display on the user interface, when a registration mark is sensed. The operator uses this information—that is, the temporal difference between each indication that a registration mark is sensed and the movement of each registration mark printed on the first web 36 past a position that is perpendicular to the position of the sensor 104—to judge the discrepancy in distance from the desired position of printing on the first web 36 relative to the printing on the second web 48. In practice, it has been found that this step of judging the degree to which the printing on the first 36 and second 48 webs is initially out of registration may be further facilitated by the placement of indicia (not shown) on the unprinted upper surface of the second web 48 corresponding in position to the position of at least some of the registration marks on the opposing lower surface of that web 48. These indicia permit an operator to directly visualize when each successive registration mark on the second web 48 is passing the position of the sensor 104, such that the operator is effectively visually gauging the longitudinal separation between registration marks on each of the first 36 and second 48 webs, and incrementally adjusting the rotational speed of the printing cylinder 101 in the manner herein described until such adjustment brings the registration marks into approximately vertical alignment proximate the position of the sensor 104; that is, until the printing applied to the first web 36 is in registration with the printing provided on the second web 48.

To further facilitate "start-up," the initial rate of travel of the first 36 and second 48 webs is preferably, though not necessarily, lower relative to the rate of travel of these webs following initial registration. This enables an operator to more easily visualize the registration marks printed on the first web 36 (and, as applicable, any additional indicia provided on the unprinted surface of the second web 48 in the manner described), and to judge the discrepancy between these registration marks and the registration marks printed on the second web 48. Though not intended to be limiting, a "start-up" speed of each of the first 36 and second 48 webs of approximately 60 fpm, as compared to a "production speed" of between approximately 160 fpm to approximately 290 fpm, has been found in practice to be sufficient to enable an operator to visualize the registration marks printed on the first web 36, and judge the discrepancy between these registration marks and the registration marks printed on the second web 48.

Figure 7:
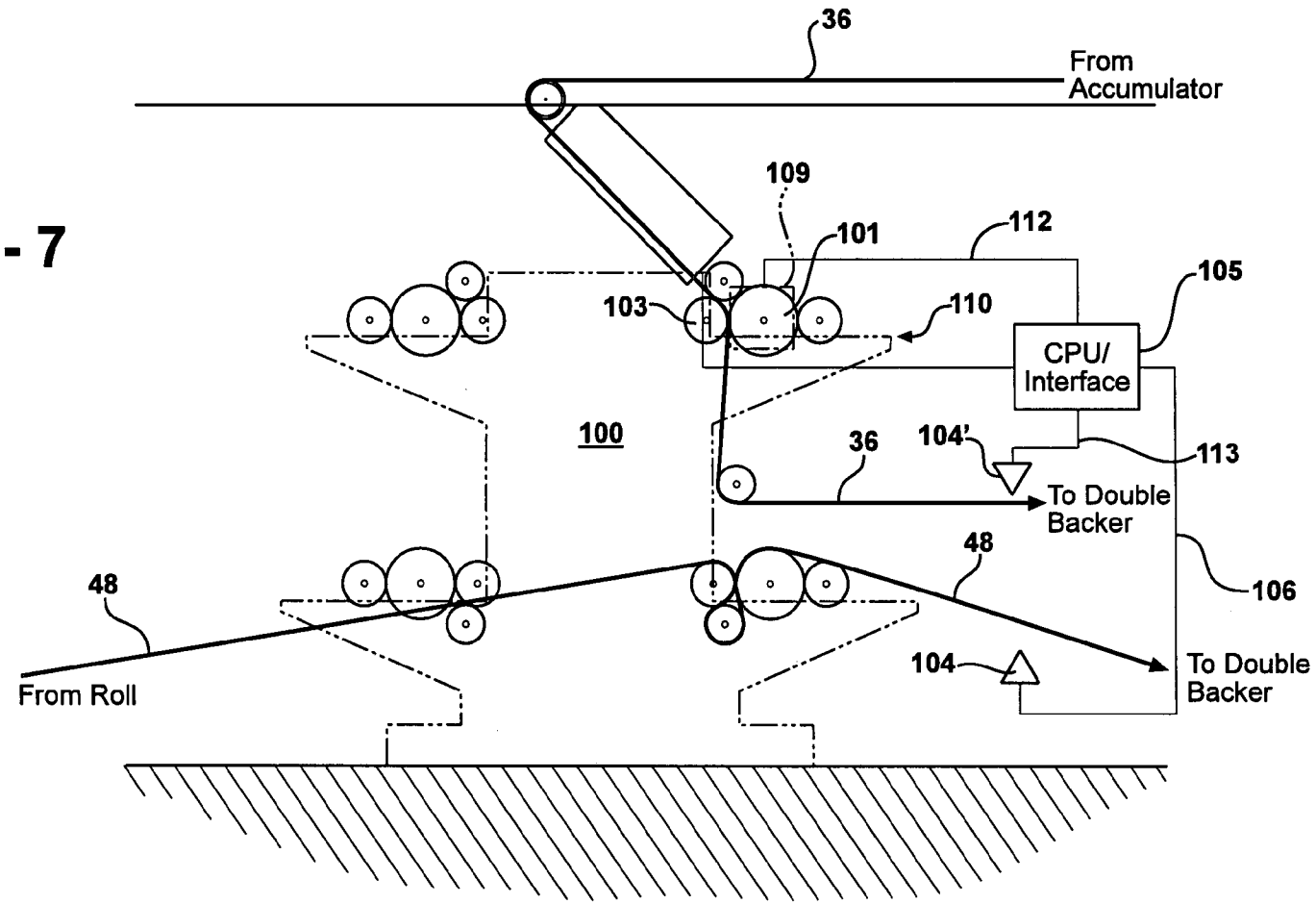
FIG. 7 depicts an alternate embodiment of the apparatus of the present invention.

In an alternate embodiment of the present invention, shown in FIG. 7, it is contemplated that the apparatus include at least a second sensor 104', such as a photo-eye, positioned proximate the upper, printed surface of the first web 36 in vertical alignment with the sensor 104. The sensor 104' is operative to detect the registration marks printed on the first web 36. The computer controller 105 is operatively connected 113 to the sensor 104' to receive information therefrom corresponding to the position of the registration marks on the first web 36. The computer controller 106 is further operative to determine any temporal discrepancy between the sensing of each registration mark at the sensor 104' and the sensing of each registration mark at the sensor 104, to calculate from this temporal discrepancy the distance of misalignment between these registration marks on each of the first 36 and second 48 webs, to calculate the degree of adjustment necessary to the rotational speed of the printing cylinder 101, and to effect such change in the degree of the rotational speed of the printing cylinder 101 to bring the registration marks into vertical alignment proximate the position of the sensor 104; that is, to bring the printing applied to the first web 36 into registration with the printing provided on the second web 48.

Once the printing applied by the printing cylinder 101 is registered to the printing provided on the second web 48, this registration is held by the computer controller 105, which receives signals from the encoder 105 corresponding to the rotational speed of the impression cylinder 103 (corresponding to the rate of travel through the apparatus of the inside and outside webs), and matches the rotational speed of the printing cylinder 101, via the motor 109, to the rotational speed of the impression cylinder 103. In this fashion, it will be appreciated that the indicia applied to the first web 36 with each rotation of the printing cylinder 101 will coincide with the corresponding indicia provided on the second web 48.

In the "hold registration" condition of operation, the sensing of each successive registration mark printed on the second web 36 will coincide with a predefined beginning point in the rotation of the printing cylinder 101; that is, the point in the rotation of the printing cylinder 101 where the indicia are applied anew to the first web 36. Accordingly, each rotation of the printing cylinder 101 places these indicia between successive registration marks on the second web 48. Ideally, the hold registration operation is sufficient to maintain this registration throughout the operation of the apparatus following start-up. In practice, however, factors such as stretching and shrinkage of the second web 48 introduce discrepancies between the sensing of the registration marks on the second web 48 by the sensor 104 and the beginning point in the rotation of the printing cylinder 101. Because the second web 48 contains the pre-printed indicia, such shrinkage or stretching results in the accumulation of relative displacement in the indicia continually applied by the printing cylinder 101 at the constant speed set by the speed of the impression cylinder 103. Given that the rates of travel of both the first 36 and second 48 webs is constant despite such shrinkage or stretching in the second web 48, the introduction of such misalignment in the placement of printing by the printing cylinder 101 may be easily corrected by the computer controller 105. More particularly, the computer controller 105 is operative to track and record the number of registration marks sensed by the sensor 104 in a given period of time when the apparatus is in the hold-registration condition, and to translate any variance from this frequency into a corresponding adjustment in the rotational speed of the printing cylinder 101 necessary to bring the printing applied by the printing cylinder 101 back into registration with the printing on the second web 48 in the manner hereinabove described. Thus, when registration marks are sensed by the sensor 104 with less frequency as compared to a given period of time when the apparatus was in a hold-registration condition, the second web 48 has stretched. The degree of stretch in distance is calculated by the computer controller 105 based upon the frequency with which the registration marks are sensed by the sensor 104. The computer controller 105 then calculates the temporary decrease in the rotational speed of the printing cylinder 101 necessary to bring the printing applied by the printing cylinder 101 back into registration with the printing provided on the second web 48, and effects such change via the motor 109 and associated gear box 111. When, on the other hand, the registration marks are sensed by the sensor 104 with greater frequency as compared to a given period of time when the apparatus was in a hold-registration condition, this indicates that the second web 48 has shrunk. In this circumstance, the computer controller 105 calculates the temporary increase in the rotational speed of the printing cylinder 101 necessary to bring the printing applied by the printing cylinder 101 back into registration with the printing on the second web 48, and effects such change via the motor 109 and associated gear box 111.

In order to maximize the value of printed paperboard containers, it is commonplace to provide indicia over the majority of the surface area of the printed face of the second web 48. Consequently, such indicia may extend into and occupy the area defining the longitudinal axis along which registration marks are provided on the second web 48. This overlap in printing may be sensed by the sensor 104, leading the computer controller 105 to register the sensing of a registration mark in error. To eliminate this potential error, the present invention provides means for selectively disengaging the sensor 104 to prevent sensing such printing as may otherwise appear to the sensor 104 between successive registration marks on the second web 48. Specifically, the computer controller 105 is programmed to define an operational window for the sensor 104, the operational window defined as a percentage of the circumference of the product of the printing cylinder 101 divided by the number of registration marks printed in a single revolution of the printing cylinder 101. The computer controller 105 then selectively activates the sensor 104 for a period of time corresponding to the longitudinal dimension of the window, as determined by the rate of travel of the second web 48 through the apparatus. The sensor 104 window is coordinated to the sensing of each registration mark by the sensor 104. That is, when a registration mark is sensed by the sensor 104, the computer controller 105 disables the sensor 104 for a period of time corresponding to the longitudinal distance on the second web 48 that is the difference between the circumference of the printing cylinder 101 and the longitudinal dimension of the window. Thereafter, the sensor 104 is enabled and looks for the next registration mark within the defined window. It will of course be understood that the computer controller 105 may be programmed to physically enable operation of the sensor 104 only during the predefined window of operation, or, alternatively, that the computer controller 105 may instead be programmed to simply disregard input from the sensor 104 except as sensed within that predefined window of operation.

Due to such factors as web shrinkage and stretching, and the accumulated longitudinal displacement of the registration marks resulting therefrom, the registration marks provided on the second web 48 may move outside of the operational window of the sensor 104. To correct such error, the computer controller 105 is further programmed to expand the operational window of the sensor 104 by a predefined amount when registration marks on the second web 48 are not sensed by the sensor 104 within the operational window for a predefined duration (defined in the exemplary embodiment as a predefined number of repeats). In the exemplary embodiment, the computer controller 105 is programmed to expand the operational window of the sensor 104 by 1.25 times when ten (10) successive registration marks (i.e., ten repeats) have not been sensed in the operational window of the sensor 104. Using the previous example, the window of 7.225 inches would be expanded to 10.625 inches when the registration marks had gone undetected by the sensor 104 for ten repeats.

It will be appreciated that the invention as described provides an apparatus and method for the continuous formation of paperboard box blanks wherein the printed indicia provided on separate continuous webs of paperboard material may be easily and efficiently aligned before these separate webs are joined together and cut and scored to define individual box blanks.

Of course, the foregoing disclosure is exemplary of the invention only, and is not intended to be limiting thereof. Other modifications, alterations, and variations thereof, within the level of ordinary skill in the art, are certainly possible, with the benefit of this disclosure, without departing from the spirit and broader aspects of the invention as set forth in the appended claims.

What is claimed is:

1. In an in-line apparatus for creating paperboard carton blanks from a unitary paperboard web formed from at least first and second continuous webs of paperboard material moving at approximately the same rate of travel through the apparatus, wherein the second web is pre-printed, an apparatus for printing the first web of paperboard material before the first and second webs are joined to define the unitary paperboard web, such that the printing on the first web is controllably registered to the printing on the second web, the apparatus comprising:

A printer for repetitively applying indicia to the first continuous web of paperboard material at predetermined intervals along the longitudinal axis thereof as the first continuous web moves through the printer, the printer including a motor-driven printing cylinder having a circumferential printing surface, and an impression cylinder;

At least a first sensor operative to detect reference marks pre-printed on the second web at predetermined intervals along the longitudinal axis thereof;

At least one encoder operative to generate signals corresponding to the rotational speed of the impression cylinder; and A computer controller:

1) connected to the at least first sensor to receive information corresponding to the position of the reference marks pre-printed on the second web;

2) connected to the at least one encoder to receive signals corresponding to the rotational speed of the impression cylinder; and 3) connected to the printing cylinder motor and operative to match the rotational speed of the printing cylinder to the rotational speed of the impression cylinder as established by the at least one encoder, and further operative to selectively adjust the rotational speed of the printing cylinder in order to bring the printing applied by each revolution of the printing cylinder into the area defined between adjacent reference marks on the second continuous web as detected by the at least first sensor.

2. The apparatus of claim 1, further comprising a second sensor operative to detect reference marks printed on said first web at predetermined intervals along the longitudinal axis thereof, said computer controller being connected to said second sensor to receive information corresponding to the position of the reference marks on said first web, and wherein further said computer controller is operative to determine the existence of a temporal discrepancy between the sensing of each reference mark on said second web by said first sensor and the sensing of each reference mark on said first web by said second sensor, and to automatically adjust the rotational speed of the printing cylinder in order to synchronize the sensing of each reference mark on said second web by said first sensor with the sensing of each reference mark on said first web by said second sensor.

3. The apparatus of claim 2, wherein said first and second sensors are in vertical alignment.

4. The apparatus of claim 1, further comprising a cylinder operatively connected to the impression cylinder for synchronous movement therewith, the second continuous web being nipped to said cylinder such that movement of the first and second webs is synchronized through the apparatus proximate the printer.

5. The apparatus of claim 1, wherein the circumferential printing surface of the printing cylinder defines a gap of predetermined width about the circumference of the printing cylinder, and wherein further selective adjustments in the rotational speed of the printing cylinder made by the computer controller are effected at each point in the revolution of the printing cylinder where the gap is adjacent the first web.

6. The apparatus of claim 1, wherein the computer controller is further operative to selectively disengage the at least first sensor for a period of time corresponding to a longitudinal distance on the second continuous web defined between successive reference marks pre-printed on the second continuous web.

7. A method, employed in an in-line apparatus for creating paperboard carton blanks from an unitary paperboard web formed from at least first and second continuous webs of paperboard material moving at approximately the same rate of travel through the apparatus, for applying printing to the first web of paperboard material before the first web is joined to the second, pre-printed web of paperboard material to define the unitary paperboard web, such that the printing applied to the first web is controllably registered to the printing on the second web, the method comprising the following steps:

Providing a printer including a motor-driven printing cylinder having a circumferential printing surface, and an impression cylinder;

Providing at least a first sensor operative to detect reference marks pre-printed on the second web at predetermined intervals along the longitudinal axis thereof Providing at least one encoder operative to generate signals corresponding to the rotational speed of the impression cylinder;

Initially applying indicia to the first continuous web of paperboard material at predetermined intervals along the longitudinal axis thereof as the first continuous web moves through the printer, and aligning such indicia in the area defined between adjacent reference marks on the second continuous web through selective adjustments in the rotational speed of the printing cylinder;

Subsequently matching the rotational speed of the printing cylinder to the rotational speed of the impression cylinder as established by the at least one encoder so as to successively apply indicia to the first continuous web between adjacent reference marks on the second continuous web; and Responding to variations in the frequency of detection of reference marks by the at least first sensor by selectively adjusting the rotational speed of the printing cylinder to bring the indicia applied by each revolution of the printing cylinder back into the area defined between adjacent reference marks on the second continuous web.

8. The method of claim 7, wherein the step of initially applying indicia to the first continuous web of paperboard material at predetermined intervals along the longitudinal axis thereof as the first continuous web moves through the printer, and aligning such indicia in the area defined between adjacent reference marks on the second continuous web through selective adjustments in the rotational speed of the printing cylinder is effected manually.

9. The method of claim 7, further comprising the step of providing a computer controller:

1) connected to the at least first sensor to receive information corresponding to the position of the reference marks pre-printed on the second web;
2) connected to the at least one encoder to receive signals corresponding to the rotational speed of the impression cylinder; and
3) connected to the printing cylinder motor and operative to match the rotational speed of the printing cylinder to the rotational speed of the impression cylinder as established by the at least one encoder, and further operative to selectively adjust the rotational speed of the printing cylinder in order to bring the printing applied by each revolution of the printing cylinder into the area defined between adjacent reference marks on the second continuous web as detected by the at least first sensor; and Wherein the steps of subsequently matching the rotational speed of the printing cylinder to the rotational speed of the impression cylinder and responding to variations in the frequency of detection of reference marks by the at least first sensor by selectively adjusting the rotational speed of the printing cylinder to bring the indicia applied by each revolution of the printing cylinder back into the area defined between adjacent reference marks on the second continuous web are both effected by the computer controller.

10. The method of claim 7, wherein the circumferential printing surface of the printing cylinder defines a gap of predetermined width about the circumference of the printing cylinder, and wherein further the steps of making selective adjustments in the rotational speed of the printing cylinder are effected at each point in revolution of the printing cylinder where the gap is adjacent the first web.

11. The method of claim 9, wherein the computer controller is further operative to selectively disengage the at least first sensor for a period of time corresponding to a longitudinal distance on the second continuous web defined between successive reference marks pre-printed on the second continuous web.

12. The method of claim 7, further comprising a cylinder operatively connected to the impression cylinder for synchronous movement therewith, the second continuous web being nipped to said cylinder such that movement of the first and second webs is synchronized through the apparatus proximate the printer.

13. A method, employed in an in-line apparatus for creating paperboard carton blanks from an unitary paperboard web formed from at least first and second continuous webs of paperboard material moving at approximately the same rate of travel through the apparatus, for applying printing to the first web of paperboard material before the first web is joined to the second, pre-printed web of paperboard material to define the unitary paperboard web, such that the printing applied to the first web is controllably registered to the printing on the second web, the method comprising the following steps:

Providing a printer including a motor-driven printing cylinder having a circumferential printing surface, and an impression cylinder;

Providing at least a first sensor operative to detect reference marks pre-printed on the second web at predetermined intervals along the longitudinal axis thereof;

Providing a second sensor operative to detect reference marks printed on said first web at predetermined intervals along the longitudinal axis thereof;

Providing at least one encoder operative to generate signals corresponding to the rotational speed of the impression cylinder;

Initially applying indicia to the first continuous web of paperboard material at predetermined intervals along the longitudinal axis thereof as the first continuous web moves through the printer, and aligning such indicia in the area defined between adjacent reference marks on the second continuous web;

Subsequently matching the rotational speed of the printing cylinder to the rotational speed of the impression cylinder as established by the at least one encoder so as to successively apply indicia to the first continuous web between adjacent reference marks on the second continuous web; and Responding to temporal discrepancies between the sensing of each reference mark on said second web by said first sensor and the sensing of each reference mark on said first web by said second sensor by selectively adjusting the rotational speed of the printing cylinder to bring the indicia applied by each revolution of the printing cylinder back into the area defined between adjacent reference marks on the second continuous web.

14. The method of claim 13, wherein said at least first and second sensors are in vertical alignment.

15. The method of claim 13, further comprising a cylinder operatively connected to the impression cylinder for synchronous movement therewith, the second continuous web being nipped to said cylinder such that movement of the first and second webs is synchronized through the apparatus proximate the printer.

16. The method of claim 13, wherein the circumferential printing surface of the printing cylinder defines a gap of predetermined width about the circumference of the printing cylinder, and wherein further selective adjustments in the rotational speed of the printing cylinder made by the computer controller are effected at each point in the revolution of the printing cylinder where the gap is adjacent the first web.

17. The method of claim 13, wherein the computer controller is further operative to selectively disengage the at least first sensor for a period of time corresponding to a longitudinal distance on the second continuous web defined between successive reference marks pre-printed on the second continuous web.

* * * * *

UNITED STATES PATENT AND TRADEMARK OFFICE

CERTIFICATE OF CORRECTION

PATENT NO. : 7,114,444 B2
APPLICATION NO. : 10/837532
DATED : October 3, 2006
INVENTOR(S) : Arthur C. Hutchinson and Mark A. Blackburn It is certified that error appears in the above-identified patent and that said Letters Patent is hereby corrected as shown below:

1. Col. 2, Line 45, please delete “paper board” and insert -- paperboard --; and 2. Col. 2, Line 51, please delete “a the first” and insert -- a first --.

Signed and Sealed this

Third Day of July, 2007

JON W. DUDAS
*Director of the United States Patent and Trademark Office*